US005803265A

United States Patent [19]

Bergerman

[11] Patent Number: 5,803,265

[45] Date of Patent: Sep. 8, 1998

[54] PATIO TABLE TRAY

[75] Inventor: Jerome W. Bergerman, Victoria, Canada

[73] Assignee: Roman W. Bergerman, Canada; a part interest

[21] Appl. No.: 749,535

[22] Filed: Nov. 15, 1996

[51] Int. Cl.[6] ..... B65D 1/34

[52] U.S. Cl. ..... 206/557; 211/107

[58] Field of Search ..... 206/557, 564; 211/126.1, 133.4, 78, 107; 248/218.4; 220/770

[56] References Cited

U.S. PATENT DOCUMENTS

| | | | |
|---|---|---|---|
| D. 75,146 | 5/1928 | Beardsley | D7/550 |
| D. 81,683 | 7/1930 | Bowtell | D7/550 |
| 96,773 | 11/1869 | Burnham | 211/107 |
| 116,233 | 6/1871 | Smith | 211/107 |
| D. 135,524 | 4/1943 | Johnstone | D7/550 |
| D. 145,764 | 10/1946 | Zelov | D44/10 |
| D. 154,300 | 6/1949 | Morris | 211/126.1 |
| 167,777 | 9/1875 | Munson et al. | 211/107 |
| D. 219,051 | 10/1970 | Eckdahl | D44/10 |
| D. 276,043 | 10/1984 | Fitzner et al. | D14/13 |
| D. 291,635 | 9/1987 | Dickman | D6/509 |
| D. 291,957 | 9/1987 | Stevens | D7/70 |
| D. 308,461 | 6/1990 | Hosea | D7/549 |
| D. 324,148 | 2/1992 | Dickman | D6/511 |
| D. 364,057 | 11/1995 | Bowman | D6/511 |
| 475,149 | 5/1892 | Pearson | 211/107 |
| 2,805,109 | 9/1957 | Kopmar | 311/17 |
| 3,626,871 | 12/1971 | McClendon | 108/151 |
| 4,682,813 | 7/1987 | Fohr | 297/192 |
| 5,010,826 | 4/1991 | Kudlac | 108/25 |
| 5,133,472 | 7/1992 | Koda et al. | 220/770 |
| 5,335,803 | 8/1994 | O'Brien et al. | 211/107 |
| 5,390,798 | 2/1995 | Yanuzzi | 206/562 |
| 5,395,081 | 3/1995 | Vollink | 248/218.4 |
| 5,419,455 | 5/1995 | Russeau | 220/575 |

*Primary Examiner*—David T. Fidei
*Attorney, Agent, or Firm*—Renner, Otto, Boisselle & Sklar, P.L.L.

[57] ABSTRACT

The present invention relates to a tray which is useful for use on a patio table having an umbrella post. The tray of the present invention has a slot to receive the umbrella post and as such, may be centrally placed, and slidably rotated around the post.

10 Claims, 2 Drawing Sheets

PATIO TABLE TRAY

FIELD OF THE INVENTION

This invention relates generally to trays and, in particular, to service trays.

BACKGROUND OF THE INVENTION

Trays are commonly used to support or serve food and beverages.

Trays may have compartments or other design features for carrying specific items or suited for specific purpose. For example, U.S. Design Pat. Nos. 219,051 to Eckdahl and 145,764 to Zelov disclose trays having various compartments. U.S. Design Pat. No. 135,524 to Johnstone discloses an infant's weaning tray having a bib-like shape.

As well, U.S. Pat. No. 5,390,798 to Yanuzzi describes a support tray having a first and a second opening designed to receive a beverage vessel and food plate, respectively, in a non-top heavy fashion. The tray also has a first and a second thumb notch which allow the tray to be carried by both the right and left hand.

Trays for attachment to a vertical post are also known, such as that disclosed in U.S. Design Pat. No. 324,148 to Dickman. U.S. Design Pat. No. 291,635 also to Dickmnan discloses a portable tray for attachment to a beach umbrella. U.S. Pat. No. 2,805,109 to Kopmar is similarly directed to a removable table attachment for beach umbrellas comprising a central aperture for attachment to the umbrella shaft.

A patio table is commonly used with an umbrella, which, typically, is mounted on the table by attaching the post of the umbrella to an aperture or other opening centrally provided on the table. The presence of the post on the table provides an obstruction which may interfere with the central placement of a tray carrying various items of food or beverages. This may be particularly problematic if an orderly, central placement of various food or beverage item is desired for the table.

The present invention is directed to a tray which is useful for use with a patio table having a post.

SUMMARY OF THE INVENTION

In one aspect, this invention relates to a service tray for placement on a patio table having a post extending above a top surface of the table, said tray comprising:

a base having a slot for receiving said post, said slot having a length and a substantially uniform width, and extending from an outward opening inwardly to a central region of said base, said slot defining first and second opposed side edges for guiding said tray about said post and an inner edge extending from said first side edge to said second side edge in said central region for engagement with said post wherein said length is substantially greater than said width; and a peripheral wall extending upwardly from said base, along a periphery of said base, and around a circumference of said base such that said wall is continuous and said wall extends along side of, and around, said slot.

In another aspect, this invention relates to a service tray for placement on a patio table having a post extending above a top surface of the table, said tray comprising: a base having a generally circular outline; said base having a slot for receiving said post, said slot having a length and a substantially uniform width, sand extending from an outward opening radially into a central region of said base, said slot defining first and second opposed side edges for guiding said tray about said post and an inner edge extending from said first side edge to said second side edge in said central region for engagement with said post wherein said length is substantially greater than said width; a peripheral wall extending upwardly from said base, along a periphery of said base, and around a circumference of said base such that said wall is continuous and said wall extends along side of, and around, said slot.

DETAILED DESCRIPTION OF PREFERRED EMBODIMENTS

Figure 1:
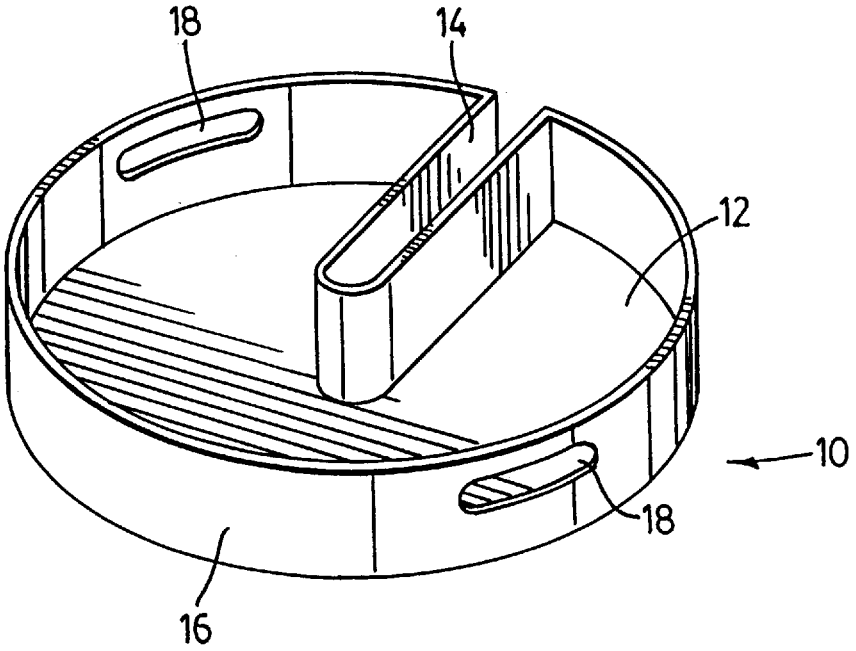
FIG. 1 is a perspective view of one embodiment of the present invention.
Figure 2:
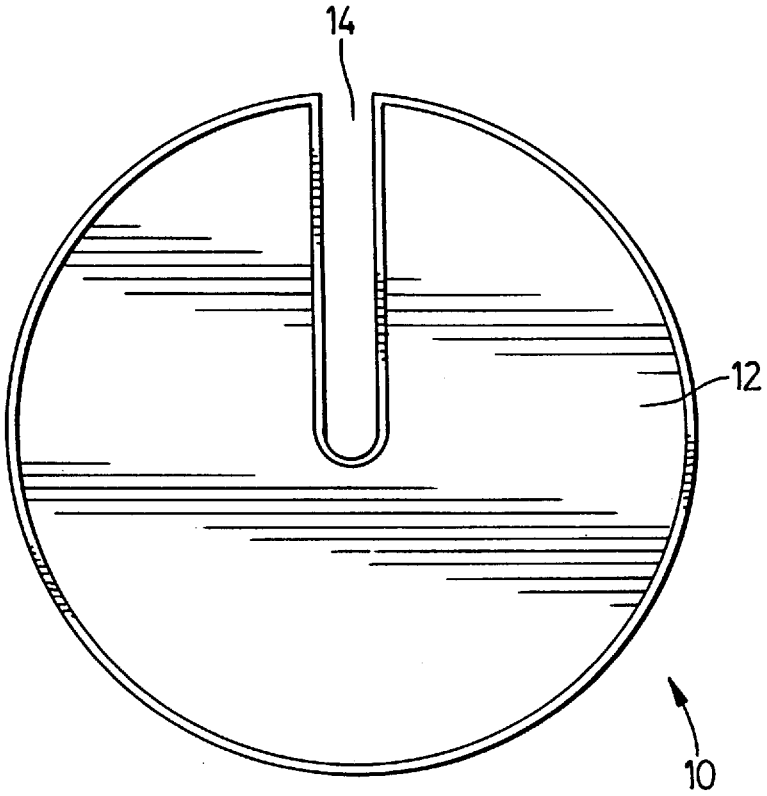
FIG. 2 is a top plan view of this embodiment.

Referring to FIG. 1, a preferred tray of the present invention is generally designated by the numeral 10. This tray 10 comprises a base 12 having a top face and a bottom face. The bottom face may be substantially flat for placement on a table. The top face may also be substantially flat, or it may be compartmentalized to carry specific food and beverage items. Tray 12 further comprises an outwardly opening slot 14, having a substantially uniform width, which extends inwardly to a central portion of base 12.

There is, extending from base 12 an upwardly extending wall 16 having handle slots 18. Wall 16 extends along a periphery of base 12 and around a circumference of base 12 such that wall 16 is continuous and extends along side of, and around slot 14. Wall 16 helps to retain the various items within the tray, and, together with handle slots 18, facilitate the carrying of the tray. Handle slots 18, on the underside, may be reinforced with plastic ribbing to facilitate gripping of the handle holes.

The tray of the present invention may be injection molded plastic or any other suitable material, such as wood and metal.

In use, tray 10 may be placed in the centre of a patio table even though an umbrella post or other such obstructive post may be centrally placed on the table, by sliding the post into slot 14 until the inner end of slot 12, at the central portion of the tray, abuts the post. With the post received by slot 14, the tray 10 may be rotated about the post such that the tray functions as a "lazy-Susan". As patio table posts are generally round, the inner contour of slot 14 at its inner end is generally rounded to complement the shape of the post. This further facilitates rotating tray 10 about the post. The substantially flat bottom face of base 12 also facilitates rotating of tray 10 about the post, as well as even placement of the tray on the table. Moreover, the generally circular shape of tray 10 ensures that the same area of the table is occupied by tray 10 as it is slidably rotated about the post and therefore, the tray may be rotated about the post without displacing or otherwise interfering with other objects placed on the table.

Although the preferred embodiment of the present invention is shown as a round tray, the tray according to the present invention may be of variety of shapes. Similarly, the inner contour of slot 14 may be varied to complement the shape of the post. The width of slot 14 may also be varied to conform to the diameter of the post on the table.

One skilled in the art will readily appreciate that numerous other modifications and variations of the present invention are possible without departing from the scope or spirit of the present invention. Such modifications and variations are therefore also within the scope of the present invention.

What is claimed is:

1. A service tray for placement on a table having a post extending above a top surface of the table, said tray comprising:

a base having a slot for receiving said post, said slot having a length and a substantially uniform width, sand extending from an outward opening inwardly to a central region of said base, said slot defining first and second opposed side edges for guiding said tray about said post and an inner edge extending from said first side edge to said second side edge in said central region for engagement with said post wherein said length is substantially greater than said width;

a peripheral wall extending upwardly from said base, along a periphery of said base, and around a circumference of said base such that wall is continuous and said wall extends along side of, and around, said slot.

2. The service tray of claim 1 wherein said base has a circular outline punctuated by said slot.

3. The service tray of claim 2 wherein said slot extends radially in said base to a central axis of said base.

4. The service tray of claim 1 wherein said peripheral wall defines an elongate slot for use as a handle.

5. The service tray of claim 1 wherein said inner edge of said slot is rounded to facilitate a rotating coupling with said post.

6. A service tray for placement on a table having a post extending above a top surface of the table, said tray comprising:

a base having a generally circular outline;

said base having a slot for receiving said post, said slot having a length and a substantially uniform width, and extending from an outward opening radially in to a central region of said base, said slot defining first and second opposed side edges for guiding said tray about said post and an inner edge extending from said first side edge to said second side edge in said central region for engagement with said post wherein said length is substantially greater than said width;

a peripheral wall extending upwardly from said base, along a periphery of said base, and around a circumference of said base such that said wall is continuous and said wall extends along side of, and around, said slot.

7. The service tray of claim 6 wherein said inner edge of said slot is rounded to facilitate a rotating coupling with said post.

8. The service tray of claim 6 wherein said peripheral wall defines an elongate slot for use as a handle.

9. The service tray of claim 6 wherein said first and second side edges are parallel.

10. The service tray of claim 1 wherein said first and second side edges are parallel.

* * * * *

UNITED STATES PATENT AND TRADEMARK OFFICE

CERTIFICATE OF CORRECTION

PATENT NO. : 5,803,265

DATED : September 8, 1998

INVENTOR(S) : Jerome W. Bergerman

It is certified that error appears in the above-identified patent and that said Letters Patent is hereby corrected as shown below:

IN THE CLAIMS

Claim 1, column 3, line 6, cancel "sand" and insert --and--.

Claim 1, column 3, line 16, after "said base such that" insert --said--.

Signed and Sealed this

Twenty-third Day of February, 1999

*Attest:*

Q. TODD DICKINSON

*Attesting Officer*

*Acting Commissioner of Patents and Trademarks*